US010339910B2

(12) United States Patent
Valeri et al.

(10) Patent No.: US 10,339,910 B2
(45) Date of Patent: Jul. 2, 2019

(54) SYSTEM AND METHOD FOR CANCELLING OBJECTIONABLE WIND NOISE IN A VEHICLE CABIN

(71) Applicant: GM GLOBAL TECHNOLOGY OPERATIONS LLC, Detroit, MI (US)

(72) Inventors: Frank C. Valeri, Novi, MI (US); Scott M. Reilly, Southfield, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 13 days.

(21) Appl. No.: 15/692,270

(22) Filed: Aug. 31, 2017

(65) Prior Publication Data

US 2019/0066649 A1 Feb. 28, 2019

(51) Int. Cl.
*G10K 11/178* (2006.01)
*G10K 11/16* (2006.01)

(52) U.S. Cl.
CPC ..... *G10K 11/178* (2013.01); *G10K 11/16* (2013.01); *G10K 2210/12821* (2013.01); *G10K 2210/3046* (2013.01)

(58) Field of Classification Search
CPC ..... G10K 11/178; G10K 11/16; G10K 2210/12821; G10K 2210/3046; G10K 2210/1282; B60Q 5/008
USPC ..... 381/71.4, 71.8, 71.1, 71.2, 56, 86; 701/49; 704/226
See application file for complete search history.

(56) References Cited

U.S. PATENT DOCUMENTS 6,674,865 B1 * 1/2004 Venkatesh ..... H04M 9/082 381/107
2004/0167777 A1 * 8/2004 Hetherington ..... G10L 21/0208 704/226
2009/0069984 A1 * 3/2009 Turner ..... E05F 15/71 701/49
2011/0175718 A1 * 7/2011 Inoue ..... B60Q 5/008 340/463

OTHER PUBLICATIONS

U.S. Appl. No. 15/147,407, filed May 5, 2016, Valeri et al.

* cited by examiner

*Primary Examiner* — Paul Kim
*Assistant Examiner* — Ubachukwu A Odunukwe

(57) ABSTRACT

A system for cancelling objectionable wind noise in a vehicle cabin includes a wind noise identification module that is configured to receive data from a microphone indicating a noise measured in a cabin of a vehicle and determine whether the noise is objectionable wind noise based on (i) a position of a moveable panel configured to cover an opening in a body of the vehicle and (ii) at least one of an amplitude of the noise and a frequency of the noise. The system also includes a first noise cancellation module that is configured to generate a noise cancellation waveform to mitigate the noise based on at least one of the amplitude of the noise and the frequency of the noise when the noise is objectionable wind noise.

14 Claims, 3 Drawing Sheets

SYSTEM AND METHOD FOR CANCELLING OBJECTIONABLE WIND NOISE IN A VEHICLE CABIN

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to systems and methods for cancelling objectionable wind noise in a vehicle cabin.

One type of objectionable wind noise that can be present in a cabin of a vehicle is attributable to wind buffeting. Wind buffeting is a low-frequency, high-amplitude sound that is typically present in a cabin of a vehicle when the vehicle is travelling at or near highway speeds and a window or sunroof of the vehicle is open. Wind buffeting can be very displeasing to vehicle occupants. Therefore, it may be desirable to detect and mitigate this displeasing sound.

SUMMARY

In one example according to the present disclosure, a system includes a wind noise identification module that is configured to receive data from a microphone indicating a first noise measured in a cabin of a vehicle and determine whether the first noise is objectionable wind noise based on (i) a position of a moveable panel configured to cover an opening in a body of the vehicle and (ii) at least one of an amplitude of the first noise and a frequency of the first noise. The system also includes a first noise cancellation module that is configured to, when the first noise is objectionable wind noise, generate a first noise cancellation waveform to mitigate the first noise based on at least one of the amplitude of the first noise and the frequency of the first noise and control a speaker to play a sound corresponding to the first noise cancellation waveform.

In one aspect, the system includes a microphone reconfiguration module configured to determine whether the data from the microphone is clipped and the wind noise identification module is configured to determine that the first noise is objectionable wind noise when (i) the position of the moveable panel indicates that the moveable panel is at least partially open and (ii) that the data from the microphone is clipped.

In one aspect, the wind noise identification module is configured to determine whether the first noise is objectionable wind noise based on the position of the moveable panel and both the amplitude of the first noise and the frequency of the first noise.

In one aspect, the wind noise identification module is configured to determine that the first noise is objectionable wind noise when the position of the moveable panel indicates that the moveable panel is at least partially open, the amplitude of the first noise is greater than a predetermined value, and the frequency of the first noise is within a predetermined range.

In one aspect, the predetermined value is 80 decibels and the predetermined range is from 15 hertz to 30 hertz.

In one aspect, the wind noise identification module is configured to determine whether the first noise is objectionable wind noise when a speed of the vehicle is greater than a predetermined speed and not determine whether the first noise is objectionable wind noise when the speed of the vehicle is less than or equal to the predetermined speed.

In one aspect, the system further includes a microphone control module connected to the microphone. The microphone reconfiguration module is configured to determine whether the data from the microphone is clipped and adjust a voltage range of the microphone control module to accommodate a dynamic range of the first noise detected by the microphone.

In one aspect, the first noise cancellation module is configured to generate the first noise cancellation waveform based on data recorded by the microphone after the voltage range of the microphone control module is adjusted to accommodate the dynamic range of the first noise.

In one aspect, the first noise cancellation module is configured to deactivate a second noise cancellation module when the first noise is objectionable wind noise and the second noise cancellation module is configured to generate a second noise cancellation waveform to mitigate a noise in the cabin of the vehicle other than wind noise.

In one aspect, the wind noise identification module is configured to receive data from the microphone indicating a second noise measured in the cabin of the vehicle after the sound corresponding to the first noise cancellation waveform is played and determine whether the second noise is objectionable wind noise. The first noise cancellation module is configured to reactivate the second noise cancellation module when the second noise is not objectionable wind noise.

In one example method in accordance with the present disclosure, the method includes receiving data from a microphone indicating a first noise measured in a cabin of a vehicle and determining whether the first noise is objectionable wind noise based on (i) a position of a moveable panel configured to cover an opening in a body of the vehicle and (ii) at least one of an amplitude of the first noise and a frequency of the first noise. The method further includes, when the first noise is objectionable wind noise, generating a first noise cancellation waveform to mitigate the first noise based on at least one of the amplitude of the first noise and the frequency of the first noise and controlling a speaker to play a sound corresponding to the first noise cancellation waveform.

In one aspect, the method further includes determining whether the data from the microphone is clipped and determining that the first noise is objectionable wind noise when (i) the position of the moveable panel indicates that the moveable panel is at least partially open and (ii) that the data from the microphone is clipped.

In one aspect, the step of determining whether the first noise is objectionable wind noise is based on the position of the moveable panel and both the amplitude of the first noise and the frequency of the first noise.

In one aspect, the step of determining whether the first noise is objectionable wind noise includes determining that the first noise is objectionable wind noise when the position of the moveable panel indicates that the moveable panel is at least partially open, the amplitude of the first noise is greater than a predetermined value, and the frequency of the first noise is within a predetermined range.

In one aspect, the predetermined value is 80 decibels and the predetermined range is from 15 hertz to 30 hertz.

In one aspect, the method further includes determining whether the first noise is objectionable wind noise when a speed of the vehicle is greater than a predetermined speed and not determining whether the first noise is objectionable wind noise when the speed of the vehicle is less than or equal to the predetermined speed.

In one aspect, the method further includes determining whether the data from the microphone is clipped and adjusting a voltage range in a microphone control module connected to the microphone to accommodate a dynamic range of the first noise detected by the microphone.

In one aspect, the method further includes generating the first noise cancellation waveform based on data recorded by the microphone after the voltage range of the microphone control module is adjusted to accommodate the dynamic range of the first noise.

In one aspect, the method further deactivating a second noise cancellation module when the first noise is objectionable wind noise and generating a second noise cancellation waveform to mitigate a noise in the cabin of the vehicle other than wind noise.

In one aspect, the method further includes receiving data from the microphone indicating a second noise measured in the cabin of the vehicle after the sound corresponding to the first noise cancellation waveform is played, determining whether the second noise is objectionable wind noise and reactivating the second noise cancellation module when the second noise is not objectionable wind noise.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

A system and method according to the present disclosure detects and mitigates an objectionable wind noise in a cabin of a vehicle. One example of wind noise that can be present in a cabin of a vehicle is a wind noise created from wind buffeting. The flow of air around a vehicle can create objectionable wind noises in a cabin of a vehicle if one or more windows of the vehicle are opened while the vehicle is travelling at or near highway speeds. When an occupant of the vehicle opens one of the windows, the flow of air over the vehicle at the open window can cause repeated compression and decompression of air in the vehicle cabin that results in a low-frequency wind noise that is objectionable to the vehicle occupants. The repeated compression and decompression of air in the vehicle cabin may be referred to as vortex shedding or wind buffeting, and the noise that results from wind buffeting may be referred to as wind buffeting noise. Wind buffeting noise can have a frequency in the range of 15 to 30 Hertz (Hz) and can have a sound level with an amplitude greater than 100 A-weighted decibels (dBa).

The system and method of the present disclosure receives information regarding various vehicle operating conditions or vehicle states in order to determine whether conditions exist in which an objectionable wind noise from wind buffeting is likely to be present. If such conditions exist, further data is collected to determine if an objectionable wind noise from wind buffeting is in fact present. If an objectionable wind noise is present, the system and method generates a noise cancellation waveform to mitigate the objectionable wind noise and controls a speaker to produce a sound corresponding to the noise cancellation waveform. The system and method can continue to collect information in order to determine whether the objectionable noise has been mitigated. In the process of mitigating wind noises, the system and method can interact with other auxiliary noise management systems, such as a powertrain noise cancelling system, and deactivate and reactivate such auxiliary systems.

Figure 1:
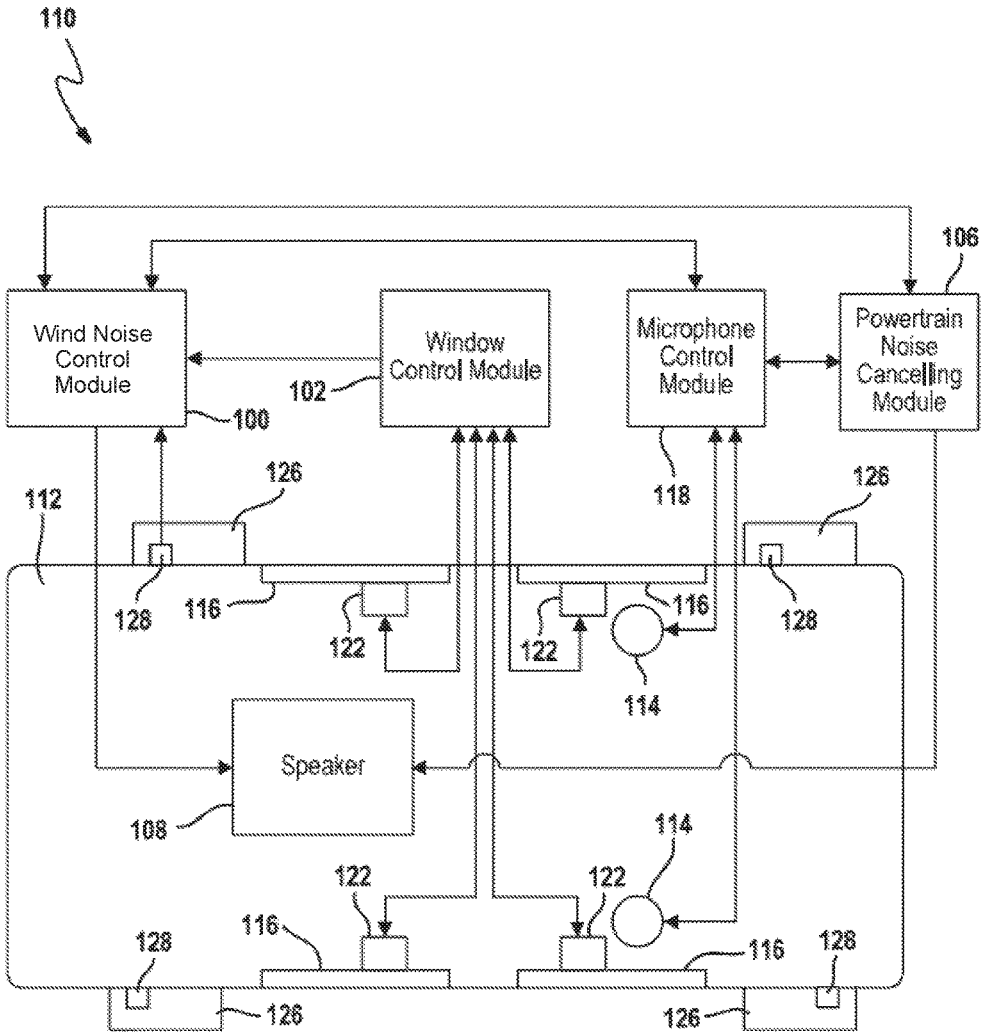
FIG. 1 is a functional block diagram of an example vehicle according to the principles of the present disclosure.

Referring now to FIG. 1, a vehicle 110 includes microphones 114, one or more windows 116, one or more window position sensors 122, wheels 126, one or more wheel speed sensors 128, a wind noise control module 100, a window control module 102, a microphone control module 118, a powertrain noise cancelling module 106 and a speaker 108. The various sensors in the vehicle 110, such as the wheel speed sensors 128 and the window position sensors 122, collect information regarding the various characteristics or conditions of the vehicle 110 and send this information to the control modules. The control modules determine various operating conditions based on the information received from the sensors. In one example, the wind noise control module 100 is connected to the wheel speed sensor 128 and determines the speed of the vehicle 110 based on an input from the wheel speed sensors 128. The wheel speed sensors 128 are mounted to the one or more wheels 126 and measure the speed of the wheel 126. The wheel speed sensor 128 sends the measured wheel speed to the wind noise control module 100. Using this information, the wind noise control module 100 determines the speed of the vehicle 110.

The window control module 102 is connected to and controls the windows 116 in the vehicle 110. The window control module 102 is connected to each window 116 and to the window position sensors 122. The window position sensor 122 can be any suitable position sensor such as a Reed sensor mounted to a motor within each window 116. The window control module 102 receives information from the window position sensor 122 regarding the status of each window 116. This information can include information regarding a location of the window 116 in the vehicle 110 (e.g., driver-side front window, passenger-side front window) and a position of the window 116 (e.g., a percentage by which the window is open). In this manner, the window control module 102 (and/or other control modules) can determine if a window is partially open, fully open, or fully closed. The window control module 102 can also determine where the window 116 is located in the vehicle 110.

The microphone control module 118 is connected to and controls the operation of the one or more microphones 114 located in a vehicle cabin 112. For example, the microphone control module 118 can turn on or turn off microphones 114 and can process a microphone signal received from the microphones 114 that indicates noise present in the vehicle cabin 112. In one example, the microphone control module 118 has a voltage range setting that it adjusts to accommodate a dynamic voltage range of the microphone signal received from the microphones 114. More specifically, the voltage level of the microphone signal increases or decreases as the level of noise in the vehicle cabin 112 increases or decreases, and the microphone control module 118 adjusts its voltage range setting according to an expected voltage level of the microphone signal. The microphone control module 118 stores the portion of the microphone signal that is within the voltage range setting and discards or clips the remaining portion of the microphone signal. Thus, adjusting the voltage range setting to be less than the expected voltage level of the microphone signal may result in noise data clipping.

In one instance, the microphone control module 118 can set the voltage range to a value of −5 to +5 volts to accommodate the dynamic range of the microphone signal that is produced by the microphones 114 in response to detecting powertrain-related noises. As can be appreciated, the microphone control module 118 can adjust the voltage range to other ranges to accommodate the dynamic range of the microphone signal that is produced by the microphones 114 in response to detecting other noises in the vehicle cabin 112.

In the context of objectionable wind noise from wind buffeting, the voltage range of the microphone signal produced by the microphones 114 is larger than −5 to +5 volts. The voltage range is larger than the voltage range typically set for detecting powertrain-related noises because the amplitude of the objectionable wind noise from wind buffeting is larger than the amplitude of the powertrain-related noises. In the context of wind buffeting, the voltage range of the microphone signal produced by the microphones 114 can be −10 to +10 volts or −12 to +12 volts. The microphone control module 118 can adjust the voltage range to accommodate either the dynamic range associated with powertrain-related noises (e.g., −5 to +5 volts) or the dynamic range associated with objectionable wind noise from wind buffeting (e.g., −10 to +10 volts).

If the microphone control module 118 sets the voltage range to a typical voltage range associated with typical powertrain-related noises (e.g., −5 to +5 volts), the microphone control module 118 will clip the microphone signal produced by the microphones 114 when the microphones 114 detect an objectionable wind noise from wind buffeting. The microphone signal is clipped because portions of the microphone signal are greater than (or less than) the voltage range of the microphone control module 118.

An unclipped microphone signal appears as a smooth sinusoidal waveform. In contrast, a clipped microphone signal does not appear as a smooth sinusoidal waveform. The portions of the clipped microphone signal that correspond to voltage values that fall outside of the voltage range of the microphone control module 118 are cut from the signal. The resulting waveform of the clipped microphone signal appears as a modified sinusoidal waveform in which the peaks and troughs are replaced by horizontal lines. As will be described further below, the wind noise control module 100 is able to determine whether the microphone signal is clipped by evaluating the microphone signal and determining whether the previously described modified sinusoidal waveform of a clipped microphone signal is present.

If a microphone signal is clipped as described above, the microphone control module 118 can reconfigure or adjust its voltage range so that the voltage range can accommodate the dynamic range of the microphone signal produced by the microphones 114. The microphone control module 118 can adjust the voltage range from a range of −5 to +5 volts to a range of −10 to +10 volts. In other instances, the microphone control module 118 can adjust the voltage range from −5 to +5 volts to −12 to +12 volts. In still other instances, the microphone control module 118 can adjust the voltage range to reduce the voltage range. The microphone control module 118 can adjust the voltage range from a range of −10 to +10 volts to a range of −5 to +5 volts or from a range of −12 to +12 volts to a range of −5 to +5 volts. In other instances, the microphone control module can adjust the voltage range to other range values to accommodate other dynamic ranges of the microphone signal that correspond to other types of noise in the vehicle cabin 112.

After the microphone control module 118 adjusts the voltage range, the microphone control module 118 can collect unclipped microphone data. The unclipped microphone data more fully and accurately describes the corresponding objectionable wind noise (or other noise). With the unclipped microphone data, the wind noise control module 100 can create a noise cancellation waveform in order to mitigate an objectionable wind noise.

Referring back to FIG. 1, the microphone control module 118 is connected to both the wind noise control module 100 and the powertrain noise cancelling module 106. The powertrain noise cancelling module 106 receives microphone data from the microphone control module 118 and creates cancellation waveforms that are reproduced by the speaker 108 (or other speakers in the vehicle 110) to mitigate objectionable powertrain noises in the vehicle 110. Such objectionable powertrain sounds can have relatively low amplitudes as compared to objectionable wind noises attributable to wind buffeting. As such, the objectionable wind noises can drown out the objectionable powertrain noises when the objectionable wind noise is present in the vehicle cabin 112. Therefore, it is desirable to mitigate the objectionable wind noise before attempting to mitigate the objectionable powertrain noises. The powertrain noise cancelling module 106 is connected to the wind noise control module 100 so that the wind noise control module 100 can deactivate the powertrain noise cancelling module when the wind noise control module 100 detects that an objectionable wind noise is present in the vehicle cabin 112.

The wind noise control module 100 detects and mitigates objectionable wind noises. The wind noise control module 100 may mitigate wind noises having a frequency within a predetermined range and/or an amplitude greater than a predetermined threshold. One example of objectionable wind noise is a noise that occurs in the vehicle cabin 112 as a result of wind buffeting. Such wind buffeting noise can have a frequency in the range of 15 to 30 Hertz (Hz) and can have a sound level with an amplitude greater than 100 dBa. Thus, the predetermined range may be 15-30 Hz and/or the predetermined threshold may be 100 dBa. In other examples, the predetermined range may be 20 to 30 Hz or 18 to 22 Hz, and/or the predetermined threshold may be 70 dBa or 80 dBa.

As shown in FIG. 1, the wind noise control module 100 is connected to the speaker 108. The speaker 108 is any suitable sound source that is capable to emit the cancellation waveforms sufficient to mitigate the detected objectionable wind noise. Examples of the speaker 108 include a ported subwoofer, a high-powered subwoofer or the like. In other examples, the vehicle 110 can include more than one speaker. For example, the vehicle 110 can include several speakers positioned at or near each of the windows 116.

In the example shown in FIG. 1, the wind noise control module 100 is also connected to the window control module 102, the microphone control module 118 and the powertrain noise cancelling module 106. Through these connections, the wind noise control module 100 receives signals indicating the status of the vehicle 110 and conditions inside the vehicle cabin 112 such as vehicle speed, position of the windows 116, and the like.

As can be appreciated, the vehicle 110 can include other modules, sensors, control systems and components not shown in FIG. 1. The wind noise control module 100 can be connected to various other modules, sensors, control systems and components to monitor the conditions of the vehicle 110 and control various aspects of the vehicle 110 to deliver the mitigation of objectionable wind noises as will be described. In other examples, the wind noise control module 100 and other modules, control systems and sensors of the vehicle 110 are connected to a vehicle information bus through which vehicle data is sent and received by the various modules, control systems and sensors of the vehicle 110.

Figure 2:
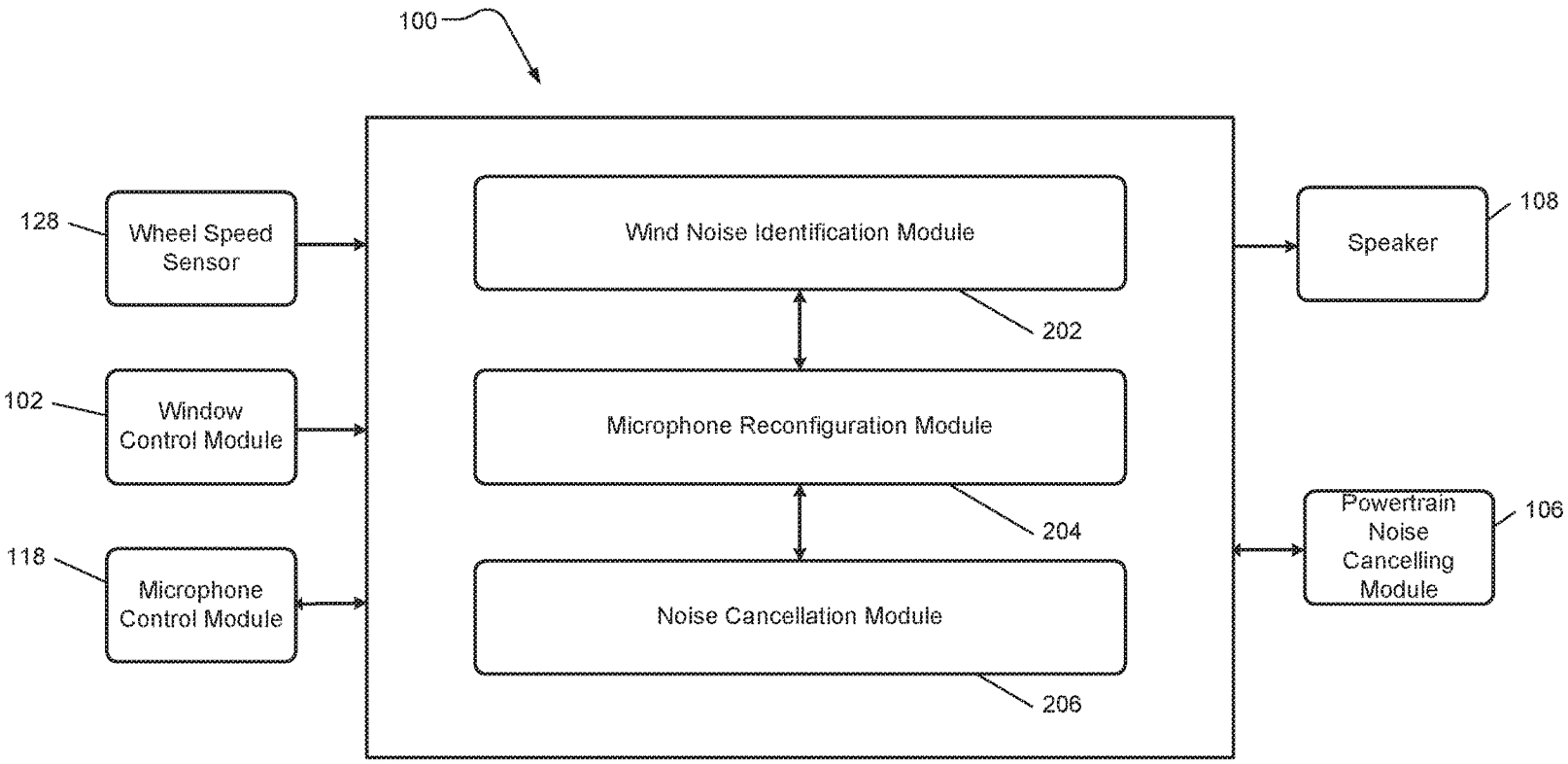
FIG. 2 is a functional block diagram of an example control system according to the principles of the present disclosure.

Referring now to FIG. 2, in one example, the wind noise control module 100 includes a wind noise identification module 202, a microphone reconfiguration module 204 and a noise cancellation module 206. As shown, the wind noise control module 100 is connected to the wheel speed sensor 128, the window control module 102, the microphone control module 118, the powertrain noise cancelling module 106 and the speaker 108. In other embodiments, the wind noise control module 100 includes modules in addition to the wind noise identification module 202, the microphone reconfiguration module 204 and the noise cancellation module 206. In other embodiments, the wind noise identification module 202, the microphone reconfiguration module 204 and the noise cancellation module 206 may be combined into a single module or may be further separated into additional modules according the functionality of the modules as will be further described.

In the illustrated example, the wind noise identification module 202, the microphone reconfiguration module 204 and the noise cancellation module 206 are connected to one another and communicate with one another to deliver the functionality as will be described. The wind noise identification module 202, in this example, receives information from the window control module 102, the powertrain noise cancelling module 106, the microphone control module 118 and the wheel speed sensor 128 to determine whether an objectionable wind noise is present.

The microphone reconfiguration module 204 communicates with the microphone control module 118 to collect sufficient microphone data to characterize the identified objectionable wind noise. The noise cancellation module 206 receives information characterizing the identified objectionable wind noise and information regarding various vehicle conditions, and generates a noise cancellation waveform to mitigate the objectionable noise. The noise cancellation module 206 communicates with and controls the speaker 108 to reproduce the noise cancellation waveform to mitigate the objectionable wind noise.

Figure 3:
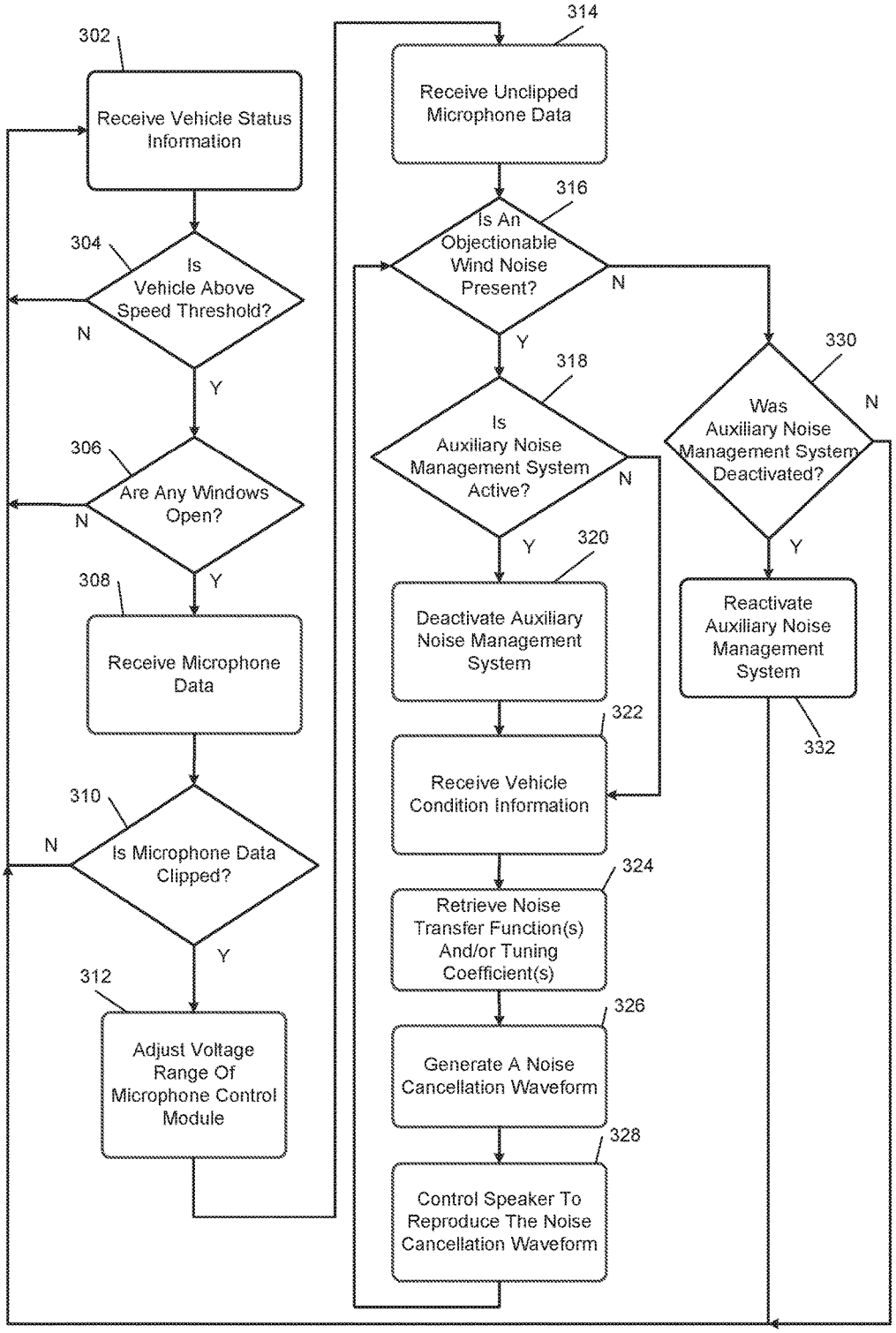
FIG. 3 is a flowchart illustrating an example method of mitigating an objectionable wind noise according to the principles of the present disclosure.

FIG. 3 shows one example method of mitigating an objectionable wind noise by the wind noise control module 100. At 302, the wind noise identification module 202 receives vehicle status information. Vehicle status information includes various types of information and data from the various modules, sensors, control systems and the like. Vehicle status information can include information such as wheel speed from the wheel speed sensor 128, the positions and/or locations of the windows 116 from the window position sensors 122, a position of a moonroof, etc. At 304, the wind noise identification module 202 determines whether the speed of the vehicle 110 is greater than a predetermined speed threshold. If the wind noise identification module 202 determines that the speed of the vehicle 110 is greater than the predetermined speed threshold, the method continues at 306. Otherwise, the method returns to 302. The wind noise identification module 202 determines the speed of the vehicle 110 based on the wheel speed received from the wheel speed sensor 128.

Objectionable wind noises from wind buffeting typically occur when a vehicle is travelling above the predetermined speed threshold. Therefore, in this example, the wind noise identification module 202 only attempts to identify objectionable noises when the vehicle 110 is travelling above the predetermined speed threshold. In one example, the predetermined speed threshold is 50 miles per hour. The predetermined speed threshold may vary depending on various aerodynamic characteristics of the vehicle 110 such as vehicle geometry. As such, the predetermined speed threshold may be greater than 50 miles per hour or less than 50 miles per hour but is typically at or near highway speeds.

At 306, the wind noise identification module 202 determines whether one or more windows 116 or other movable panels of the vehicle 110 are open based on inputs from the window position sensors 122. Objectionable wind noises often only arise when a window or other movable panel (such as a moonroof) is open. If a window or other movable panel is open, the method continues at 308. Otherwise, the method returns to 302 and the wind noise identification module 202 continues to monitor the status of the vehicle 110 to determine if the speed of the vehicle 110 is greater than the predetermined speed threshold and if one or more of the windows 116 is open before moving forward to evaluating microphone data.

At 308, the microphone reconfiguration module 204 receives microphone data from the microphone control module 118. At 310, the microphone reconfiguration module 204 evaluates the microphone data to determine if the microphone data is clipped. If the microphone reconfiguration module 204 determines that the microphone data is clipped, the method continues to 312. Otherwise, the method returns to 302.

In clipped microphone data, the waveform exhibits a modified sinusoidal shape in which the peaks and troughs are not smooth. Instead, the peaks and troughs are replaced by horizontal flat portions that correspond to portions of the noise in which the amplitude is greater than the set voltage range of the microphone control module 118. When the microphone reconfiguration module 204 detects this condition of the waveform, the microphone reconfiguration module 204 determines that the microphone data is clipped.

At 312, the microphone reconfiguration module 204 instructs the microphone control module 118 to adjust its voltage range. In response, the microphone control module 118 adjusts its voltage range to accommodate the dynamic range of microphone signals received from the microphones 114 and/or the dynamic range of the noise detected by the microphones 114. The adjustment of the voltage range by the microphone control module 118 typically includes increasing the voltage range. As previously described, the microphone control module 118 can adjust the range to any suitable range. In one example, the voltage range is adjusted from −5 to +5 volts to −10 to +10 volts.

At 314, the wind noise identification module 202 receives unclipped microphone data from the microphone control module 118. Since the microphone control module 118 adjusted its voltage range to accommodate the dynamic range of the microphone signal, the microphone data is unclipped and exhibits a complete sinusoidal shape that accurately reflects the sound in the vehicle cabin 112.

At 316, the wind noise identification module 202 determines whether an objectionable wind noise is present in the vehicle cabin 112. The wind noise identification module 202 uses one or more characteristics of the unclipped microphone data to determine if an objectionable wind noise is present. Two examples of such characteristics are frequency and amplitude of the noise. Objectionable wind noises attributable to wind buffeting can have a frequency in the range of 15-30 Hz and/or an amplitude greater than 80 dBa. Thus, the wind noise identification module 202 may determine that an objectionable wind noise is present when the cabin noise has a frequency in the predetermined range of 15-30 Hz and/or an amplitude greater than the predetermined threshold of 80 dBa. While other attributes of the cabin noise information can also be used, the example wind noise identification module 202 uses the frequency and/or amplitude of cabin noise to determine if an objectionable wind noise is present.

In the example method shown in FIG. 3, the wind noise identification module 202 determines whether an objectionable wind noise is present after receiving the unclipped microphone data at 314 as previously described. In another example method, the wind noise identification module 202 can determine that an objectionable wind noise is present when the microphone reconfiguration module 204 determines that the microphone data is clipped at 310. In such an example method, the wind noise identification module 202 receives a signal from the microphone reconfiguration module 204 indicating that the microphone data is clipped. Upon receiving this signal, the wind noise identification module 202 determines that an objectionable wind noise is present. In such example methods, the processing at 316 may be combined with and occurs at 310, the method may continue at 312 if 310 is satisfied, the method may continue at 328 if 310 is not satisfied, and the method may continue directly from 314 to 318. In addition, after completing 326, the method may continue at 310 rather than 316. Further, the wind noise identification module 202 may determine that an objectionable wind noise is present only if the frequency of the clipped data is within the predetermined range (e.g., 15-30 Hz).

In various implementations, the wind noise identification module 202 may determine that the amplitude of the cabin noise is greater than the predetermined threshold (e.g., 80 dBa) when the microphone reconfiguration module 204 determines that the microphone data is clipped at 310. However, the method may still proceed as shown in FIG. 3, and the wind noise identification module 202 may only determine that an objection wind noise is present at 316 when the frequency of the clipped data is within the predetermined range (e.g., 15-30 Hz). In these implementations, the wind noise identification module 202 may determine that the amplitude of the cabin noise is greater than the predetermined threshold without actually comparing the cabin noise amplitude to the predetermined threshold.

If the wind noise identification module 202 determines that the objectionable wind noise exists at 316, the method continues at 318. Otherwise, the method continues at 328. At 328, the noise cancellation module 206 determines whether an auxiliary noise management system was deactivated. In a circumstance in which the wind noise identification module 202 determines that an objectionable wind noise is not present and an auxiliary noise management system was not previously deactivated, the method returns to 302. The steps of the method at 328 and 330 are described further below.

At 318, the noise cancellation module 206 determines whether an auxiliary noise management system is active. The auxiliary noise management system can be any other control system in the vehicle 110 that is designed make an occupant's experience in the vehicle 110 more audibly pleasing. One example of an auxiliary noise management system is the powertrain noise cancelling module 106. The wind noise control module 100 is connected to the powertrain noise cancelling module 106 and receives signals from the powertrain noise cancelling module 106. One such signal is an indication as to whether the powertrain noise cancelling module 106 is active.

If the noise cancellation module 206 determines that an auxiliary noise management system, such as the powertrain noise cancelling module 106 is active, the method continues at 320. Otherwise, the method skips 320 and continues directly to 322. At 320, the noise cancellation module 206 deactivates the auxiliary noise management system. The noise cancellation module 206 can send a signal to the powertrain noise cancelling module 106 to deactivate the powertrain noise cancelling module 106.

As can be appreciated, the deactivation of auxiliary noise management systems may be desirable because the objectionable wind noise is so loud that it drowns out the objectionable powertrain-related noise or other objectionable noise in the vehicle cabin 112. In addition, the microphone reconfiguration module 204 may have instructed the microphone control module 118 to adjust the voltage range to accommodate the microphone signal associated with the objectionable wind noise. In this circumstance, the microphone control module 118 is adjusted to address the objectionable wind noise rather than an objectionable powertrain-related noise or other objectionable noise.

At 322, the noise cancellation module 206 receives vehicle condition information. The vehicle condition information includes information regarding various aspects of the vehicle 110 that are collected from the previously described sensors, control systems and modules. The vehicle condition information may include the position of the windows 116 from the window position sensors 122, a position of a moonroof, location of windows 116 in the vehicle 110 from the window control module 102 or the like.

At 324, the noise cancellation module 206 can retrieve one or more noise transfer functions and/or one or more tuning coefficients. The noise cancellation module 206 can use the transfer function(s) and/or the tuning coefficient(s) when it generates a noise cancellation waveform at 326. The use of the transfer function(s) and/or the tuning coefficient(s) is explained further below in the context of the generation of the noise cancellation waveform.

At 326, the noise cancellation module 206 generates the noise cancellation waveform that is designed to mitigate the objectionable wind noise. The noise cancellation waveform is a signal that characterizes a sound that can be emitted by the speaker 108 to mitigate the objectionable wind noise. The noise cancellation waveform is a signal with the same or similar frequency and the same or similar amplitude as the objectionable wind noise but is 180 degrees out of phase with the waveform that characterizes the objectionable wind noise. As can be appreciated, the frequency and the amplitude of the noise cancellation waveform may not be exactly the same as the objectionable wind noise but are similar enough to mitigate the objectionable wind noise to a noise level more pleasing to a vehicle occupant. The frequency and amplitude of the noise cancellation waveform may not be exactly the same as the objectionable wind noise, for example, in instances in which the noise cancellation module 206 uses the tuning coefficient(s) and/or the predetermined transfer function(s) as explained below.

The noise cancellation waveform is generated based on the unclipped microphone data as well as the vehicle condition information. Other information, such as the tuning coefficients, may also be used to generate the noise cancellation waveform. As can be appreciated, the objectionable wind noise can be reproduced during testing in a laboratory setting or during the development stages of the vehicle 110. During such development and/or testing, one or more transfer functions can be developed to characterize the relationship between the frequency, amplitude and/or phase of sounds played by the speaker 118 and the frequency, amplitude, and/or phase of the corresponding noise measured by the microphones 122. Each noise transfer function may characterize the relationship between the sound played by the speaker 118 and the noise measured by one of the microphones 122. In addition, each noise transfer function may correspond to certain values or ranges of vehicle operating conditions, and therefore multiple noise transfer functions may be used to characterize the relationship between the sound played by the speaker 118 and the noise measured by one of the microphones 122. Further, each noise transfer function may have one or more of the tuning coefficients, and the tuning coefficients may vary depending on the vehicle operating conditions. The vehicle operating conditions may include which one of the windows 116 is open, the percentage by which each window 116 is open, and/or the speed of the vehicle 110.

For example, a first set of transfer functions and/or tuning coefficients can be developed for a first vehicle condition in which the driver-side front window is open and is causing the objectionable wind noise from wind buffeting. A second set of transfer functions and/or tuning coefficients can be developed for a second vehicle condition in which both rear windows are open and are causing the objectionable wind noise from wind buffeting. Similarly, other sets of transfer function(s) and/or tuning coefficient(s) can be developed for other vehicle conditions (i.e., other combinations of windows or other apertures that are open and causing the objectionable wind noise). The noise cancellation module 206 can, after receiving the vehicle condition information at 322, determine the appropriate set of transfer functions and/or tuning coefficients to retrieve and use based on which windows (or other apertures) are open.

The noise cancellation module 206 can store the transfer functions and/or the tuning coefficients. The noise cancellation module 206 can select the noise transfer function(s) and/or the tuning characteristic(s) that correspond to the current vehicle operating conditions, and use those transfer function(s) and/or tuning coefficients to generate the noise cancellation waveform. The tuning coefficients can indicate that a suitable noise cancellation waveform to be played at the speaker 118 should have a frequency and/or amplitude that is different from the frequency and/or amplitude of the objectionable wind noise measured at the microphones 122.

For example, the frequency and/or amplitude of noise measured by the microphones 122 may be different than the frequency and/or amplitude of the sound played by the speaker 118, and the noise transfer functions may characterize this difference. Thus, the noise cancellation module 206 may use the noise transfer functions to generate the noise cancellation waveform so that, when the speaker 118 plays a sound corresponding to the noise cancellation waveform, the noise measured by the microphones 122 has the same amplitude and frequency as the objectionable wind noise but is 180 degrees out of phase relative to the objectionable wind noise. Since the frequency and/or amplitude of noise measured by the microphones 122 may be different than that of the sound played by the speaker 118, the frequency and/or amplitude of the noise cancellation waveform may be different than the frequency and/or amplitude of the objectionable wind noise measured by the microphones 122.

At 328, the noise cancellation module 206 controls the speaker 108 to reproduce the noise cancellation waveform. The noise cancellation module 206 sends a control signal to the speaker 108 with the characteristics (e.g., frequency, amplitude and phase) of the noise cancellation waveform. As can be appreciated, the characteristics of the control signal instruct the speaker 108 to reproduce the noise cancellation waveform such that emitted sound is the same (or similar) to the objectionable wind noise in frequency and amplitude but is 180 degrees out of phase with objectionable wind noise. The noise cancellation waveform can also be modified by the wind noise transfer function and/or the tuning coefficients as previously described. In this manner, the sound emitted by the speaker 108 mitigates the objectionable wind noise.

At this stage, the wind noise control module 100 returns to 316 and continues to monitor the microphone data and re-evaluates whether the objectionable wind noise is still present in the vehicle 110. As previously described, the wind noise identification module 202 receives the microphone data (which is unclipped microphone data) to determine if an objectionable wind noise is present. If the speaker 108 is producing a noise corresponding to the noise cancellation waveform and the noise is sufficient to mitigate the objectionable noise, the wind noise identification module 202 will not detect an objectionable noise. In this circumstance, at 330, the noise cancellation module 206 determines whether it previously deactivated an auxiliary noise management system. If the noise cancellation module 206 had previously deactivated an auxiliary noise management system, such as the powertrain noise cancelling module 106, the noise cancellation module 206 reactivates the auxiliary noise management system at 332. After the reactivation, the wind noise control module 100 and an auxiliary noise management system, such as the powertrain noise cancelling module 106, can operate simultaneously to control both objectionable wind buffeting noises and other objectionable noises in the vehicle 110.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements.

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. A system comprising:

a wind noise identification module configured to:

receive data from a microphone indicating a first noise measured in a cabin of a vehicle; and determine whether the first noise is objectionable wind noise based on (i) a position of a moveable panel configured to cover an opening in a body of the vehicle and (ii) at least one of an amplitude of the first noise and a frequency of the first noise;

a first noise cancellation module configured to:

when the first noise is objectionable wind noise, generate a first noise cancellation waveform to mitigate the first noise based on at least one of the amplitude of the first noise and the frequency of the first noise; and control a speaker to play a sound corresponding to the first noise cancellation waveform; and a microphone reconfiguration module configured to determine whether the data from the microphone is clipped, wherein the wind noise identification module is configured to determine that the first noise is objectionable wind noise when (i) the position of the moveable panel indicates that the moveable panel is at least partially open and (ii) that the data from the microphone is clipped.

2. A system comprising:

a wind noise identification module configured to:

receive data from a microphone indicating a first noise measured in a cabin of a vehicle;

determine that the first noise is objectionable wind noise when a position of a moveable panel indicates that the moveable panel is at least partially open, an amplitude of the first noise is greater than a predetermined value, and a frequency of the first noise is within a predetermined range, wherein:

the moveable panel is configured to cover an opening in a body of the vehicle;

the predetermined value is 80 decibels; and the predetermined range is from 15 hertz to 30 hertz; and a first noise cancellation module configured to:

when the first noise is objectionable wind noise, generate a first noise cancellation waveform to mitigate the first noise based on at least one of the amplitude of the first noise and the frequency of the first noise; and control a speaker to play a sound corresponding to the first noise cancellation waveform.

3. The system of claim 2 wherein the wind noise identification module is configured to:

determine whether the first noise is objectionable wind noise when a speed of the vehicle is greater than a predetermined speed; and not determine whether the first noise is objectionable wind noise when the speed of the vehicle is less than or equal to the predetermined speed.

4. A system comprising:

a wind noise identification module configured to:

receive data from a micro hone indicating a first noise measured in a cabin of a vehicle; and determine whether the first noise is objectionable wind noise based on (i) a position of a moveable panel configured to cover an opening in a body of the vehicle and (ii) at least one of an amplitude of the first noise and a frequency of the first noise; and a first noise cancellation module configured to:

when the first noise is objectionable wind noise, generate a first noise cancellation waveform to mitigate the first noise based on at least one of the amplitude of the first noise and the frequency of the first noise; and control a speaker to play a sound corresponding to the first noise cancellation waveform;

a microphone control module connected to the microphone: and a microphone reconfiguration module configured to:

determine whether the data from the microphone is clipped; and adjust a voltage range of the microphone control module to accommodate a dynamic range of the first noise detected by the microphone.

5. The system of claim 4 wherein the first noise cancellation module is configured to generate the first noise cancellation waveform based on data recorded by the microphone after the voltage range of the microphone control module is adjusted to accommodate the dynamic range of the first noise.

6. A system comprising:

a wind noise identification module configured to:

receive data from a microphone indicating a first noise measured in a cabin of a vehicle; and determine whether the first noise is objectionable wind noise based on (i) a position of a moveable panel configured to cover an opening in a body of the vehicle and (ii) at least one of an amplitude of the first noise and a frequency of the first noise; and a first noise cancellation module configured to:

when the first noise is objectionable wind noise, generate a first noise cancellation waveform to mitigate the first noise based on at least one of the amplitude of the first noise and the frequency of the first noise; and control a speaker to play a sound corresponding to the first noise cancellation waveform, wherein:

the first noise cancellation module is configured to deactivate a second noise cancellation module when the first noise is objectionable wind noise; and the second noise cancellation module is configured to generate a second noise cancellation waveform to mitigate a noise in the cabin of the vehicle other than wind noise.

7. The system of claim 6 wherein:

the wind noise identification module is configured to:

receive data from the microphone indicating a second noise measured in the cabin of the vehicle after the sound corresponding to the first noise cancellation waveform is played; and determine whether the second noise is objectionable wind noise; and the first noise cancellation module is configured to reactivate the second noise cancellation module when the second noise is not objectionable wind noise.

8. A method comprising:

receiving data from a microphone indicating a first noise measured in a cabin of a vehicle;

determining whether the data from the microphone is clipped; and determining whether the first noise is objectionable wind noise based on (i) a position of a moveable panel configured to cover an opening in a body of the vehicle and (ii) at least one of an amplitude of the first noise and a frequency of the first noise, wherein the step of determining whether the first noise is objectionable wind noise further includes determining that the first noise is objectionable wind noise when (i) the position of the moveable panel indicates that the moveable panel is at least partially open and (ii) that the data from the microphone is clipped;

when the first noise is objectionable wind noise, generating a first noise cancellation waveform to mitigate the first noise based on at least one of the amplitude of the first noise and the frequency of the first noise; and controlling a speaker to play a sound corresponding to the first noise cancellation waveform.

9. A method comprising:

receiving data from a microphone indicating a first noise measured in a cabin of a vehicle;

determining that the first noise is objectionable wind noise when a position of a moveable panel indicates that the moveable panel is at least partially open, an amplitude of the first noise is greater than a predetermined value, and a frequency of the first noise is within a predetermined range, wherein:

the moveable panel is configured to cover an opening in a body of the vehicle;

the predetermined value is 80 decibels; and the predetermined range is from 15 hertz to 30 hertz;

when the first noise is objectionable wind noise, generating a first noise cancellation waveform to mitigate the first noise based on at least one of the amplitude of the first noise and the frequency of the first noise; and controlling a speaker to play a sound corresponding to the first noise cancellation waveform.

10. The method of claim 9 further comprising:

determining whether the first noise is objectionable wind noise when a speed of the vehicle is greater than a predetermined speed; and not determining whether the first noise is objectionable wind noise when the speed of the vehicle is less than or equal to the predetermined speed.

11. A method comprising:

receiving data from a microphone indicating a first noise measured in a cabin of a vehicle;

determining whether the data from the microphone is clipped; and adjusting a voltage range in a microphone control module connected to the microphone to accommodate a dynamic range of the first noise detected by the microphone;

determining whether the first noise is objectionable wind noise based on (i) a position of a moveable panel configured to cover an opening in a body of the vehicle and (ii) at least one of an amplitude of the first noise and a frequency of the first noise;

when the first noise is objectionable wind noise, generating a first noise cancellation waveform to mitigate the first noise based on at least one of the amplitude of the first noise and the frequency of the first noise; and controlling a speaker to play a sound corresponding to the first noise cancellation waveform.

12. The method of claim 11 further comprising generating the first noise cancellation waveform based on data recorded by the microphone after the voltage range of the microphone control module is adjusted to accommodate the dynamic range of the first noise.

13. A method comprising:

receiving data from a microphone indicating a first noise measured in a cabin of a vehicle;

determining whether the first noise is objectionable wind noise based on (i) a position of a moveable panel configured to cover an opening in a body of the vehicle and (ii) at least one of an amplitude of the first noise and a frequency of the first noise;

when the first noise is objectionable wind noise, generating a first noise cancellation waveform to mitigate the first noise based on at least one of the amplitude of the first noise and the frequency of the first noise;

controlling a speaker to play a sound corresponding to the first noise cancellation waveform;

deactivating a second noise cancellation module when the first noise is objectionable wind noise; and generating a second noise cancellation waveform to mitigate a noise in the cabin of the vehicle other than wind noise.

14. The method of claim 13 further comprising:

receiving data from the microphone indicating a second noise measured in the cabin of the vehicle after the sound corresponding to the first noise cancellation waveform is played;

determining whether the second noise is objectionable wind noise; and reactivating the second noise cancellation module when the second noise is not objectionable wind noise.

* * * * *